United States Patent [19]

Imazeki et al.

[11] Patent Number: 4,919,546

[45] Date of Patent: Apr. 24, 1990

[54] TRASH BAG WITH HOLDER AND DISPOSABLE REFILL TRASH BAG

[75] Inventors: Yukio Imazeki, Tokyo; Hideo Yamaguchi, Chiba, both of Japan

[73] Assignee: D-Three Co., Ltd., Tokyo, Japan

[21] Appl. No.: 227,669

[22] Filed: Aug. 2, 1988

[30] Foreign Application Priority Data

| | | | |
|---|---|---|---|
| Aug. 4, 1987 | [JP] | Japan | 62-119553[U] |
| Sep. 4, 1987 | [JP] | Japan | 62-221447 |
| Nov. 26, 1987 | [JP] | Japan | 62-298372 |

[51] Int. Cl.[5] ..... B65D 33/14

[52] U.S. Cl. ..... 383/33; 220/403; 248/99

[58] Field of Search ..... 383/33, 117; 220/85 H, 220/403, 404; 248/99, 100, 101

[56] References Cited

U.S. PATENT DOCUMENTS

| | | | |
|---|---|---|---|
| 611,498 | 9/1898 | Lyon | 248/99 X |
| 1,458,640 | 6/1923 | Chase | 383/33 X |
| 2,457,918 | 1/1949 | Pierre | 248/99 X |
| 3,991,961 | 11/1976 | Platzer | 248/99 |
| 4,503,561 | 3/1985 | Bruno | 383/117 X |
| 4,509,570 | 4/1985 | Eby et al. | 383/33 X |
| 4,611,350 | 9/1986 | Kaczerwaski | 220/404 X |
| 4,747,701 | 5/1988 | Perkins | 383/33 |

*Primary Examiner*—Stephen M. Hepperle

*Attorney, Agent, or Firm*—Fay, Sharpe, Beall, Fagan, Minnich & McKee

[57] ABSTRACT

The present invention discloses a trash bag with a holder which comprises a bag having a smaller diameter portion at its open end, and a ring member having an external shape which is wider than the smaller diameter portion of the bag, wherein the bag is fastened to the ring member. In fastening the bag to the ring member, the ring member is first inserted into the bag edgewise, and the bag is then caused to erect upright relative to the face of the ring member with the bottom thereof positioned upwards. Afterwards the bag is caused to move downwards to pass through the interior space of the ring member while it is turned inside out. In this way, when the bag has changed its position from the upside to the downside relative to the ring member, the bag is locked by the ring member in such a way that the smaller diameter portion thereof is caught at either the lower side of the ring member of the bottom side thereof, thus making it possible to securely fasten the bag to the ring member via the smaller diameter portion, whereby the trash bag is prevented from coming off the ring member even when a heavy load is applied thereto to some extent. Moreover, in unfastening the bag from the ring member, the bag may be torn off in the upper portion thereof, or the smaller diameter portion of the bag may be pulled in one direction, thus making it possible to easily unfasten the bag from the ring member.

19 Claims, 5 Drawing Sheets

TRASH BAG WITH HOLDER AND DISPOSABLE REFILL TRASH BAG

BACKGROUND OF THE INVENTION

1. Technical Field

The present invention relates to a trash bag with a holder and a disposable refill trash bag, and more particularly to a trash bag with a holder and a disposable refill trash bag which is suitable as a trash receptacle placed in a kitchen sink in an ordinary household kitchen to put therein waste food resulting from the preparation of food. The present invention further relates to a trash bag with a holder and a disposable refill trash bag which is capable of being used in households, offices or the like as a trash can or a trash receptacle which is placed in the vicinity of a desk, dresser or table, or as a trash receptacle as used in hospitals or the like.

2. Background Art

Conventionally, trash receptacles, one of the most popular versions of which is a trash can, take several forms. For instance, triagonal prism-shaped receptacles which are mainly made of a plastic or aluminum are widely used, when placed in a kitchen sink, as garbage cans in which to place garbage or waste food. In contrast, in other places in ordinary households or offices, cylindrical or square pillar-shaped receptacles are placed by tables or desks for use as trash cans. A bag is sometimes used in such a trash or garbage receptacle so as to facilitate disposal of what is put therein. In addition to trash receptacles of those types and especially for the application of use in a kitchen sink or the like, a bag with a holder is used in which to place wasted food and other trash.

A bag with a holder has an advantage in that the disposal of waste food and other trash is easy.

In a bag with a holder, the holder is provided with a special bag fastening mechanism for securely fastening a bag thereto or a separate member is attached to the holder to hold the bag by catching therebetween the open side of the bag. However, trash bags with holders of this type have a drawback in that when engagement between the holder and the bag cannot bear the weight of the trash contained therein, the bag is thus caused to come off the holder from the engaged portion. On top of this drawback, in a case where the bag is not securely fastened on the holder, the bag is also likely to drop from the holder. Furthermore, with such a trash bag with a holder, it is troublesome and difficult to fasten and/or unfasten a bag to the holder.

SUMMARY OF THE INVENTION

The present invention is characterized by a construction which comprises a bag having a smaller diameter portion at its open end, and a frame support member having an external shape which is wider than the smaller diameter portion of the bag, wherein the bag is fastened to the frame member. In fastening the bag to the frame member, the frame member is first inserted into the bag edgewise, and the bag is then caused to erect upright relative to the face of the frame member with the bottom thereof positioned upwards. Afterwards the bag is caused to pass through the interior space of the frame member while it is turned inside out. When the bag has changed its position from the upside to the downside, the bag is locked by the frame member in such a way that the smaller diameter portion thereof is caught at either the lower side of the frame member or the bottom thereof, thus making it possible to securely fasten the bag to the frame member via the smaller diameter, whereby the trash bag is prevented from coming off the frame member even when a heavy load is applied thereto to some extent.

Moreover, in unfastening the bag from the frame member, the bag may be torn off in the upper portion thereof, or the smaller diameter portion of the bag may be pulled in one direction, thus making it possible to easily unfasten the bag from the frame member. Fastening and/or unfastening of the bag to/from the frame member may be attained more easily if either of the frame member or the bag is made of a flexible or elastic material.

Even in a case where neither the supporting frame member nor the trash bag is flexible, the bag is safely held by the frame member when fastened thereon with a certain relationship maintained between the frame member and trash bag relative to the size thereof, trash bag thus securely being held by the frame member.

This enables to provide a trash bag with a holder in which the frame member can securely fasten the trash bag thereon without any special fastening mechanism, and fastening and/or unfastening of the trash bag to/-from the frame member is easily attained.

The trash bag which is fastened to the frame member may be a bag having a smaller diameter portion or a neck portion at the open end thereof or in the vertically intermediate portion, and can easily be manufactured by joining the bag, for instance, so as to make its mouth narrower. Moreover, if a synthetic resin, which is easily welded, is used as a material for the bag, bags having a smaller diameter portion or neck portion are able to be easily manufactured.

An object of the present invention is to provide a trash bag with a holder or supporting frame member in which the trash bag is easily fastened/unfastened to/-from the holder, which facilitates the disposal of what is placed in the bag and which is adapted to be placed anywhere without any difficulties.

Another object of the present invention is to provide a trash bag with a holder in which the trash bag is securely held by the holder without providing any special fastening mechanism on the holder.

A further object of the present invention is to provide a trash bag with a holder in which the trash bag is made difficult to come off the holder without providing any special fastening mechanism but by a simple construction which achieves this object even if heavy trash is placed therein, and fastening and/or unfastening of the trash bag is easily attained when needed.

A still further object of the present invention is to provide a trash bag with a holder in which the trash bag is securely held by the holder without providing any special fastening mechanism on the holder, fastening and/or unfastening of the trash bag is easily achieved when needed, and manufacturing of the bag is also easily achieved.

DESCRIPTION OF THE PREFERRED EMBODIMENTS

Figure 1:
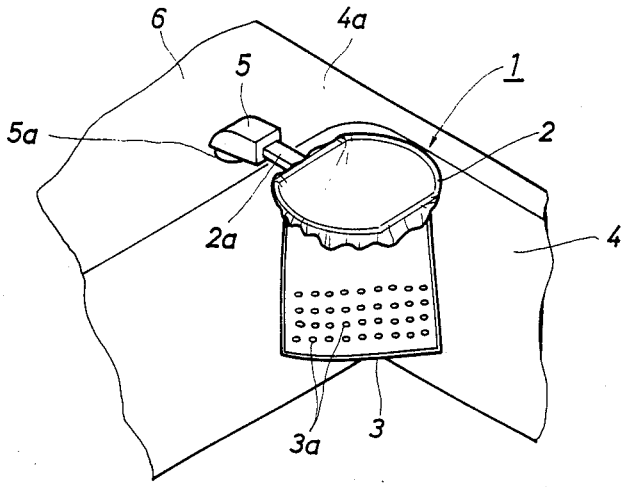
FIG. 1 is a perspective view showing one embodiment in which a trash bag with a holder according to the present invention is used as a trash receptacle in which to place waste food resulting from the preparation of food, FIG. 2 (*a*) shows a trash bag which is separated from a bag support frame of the trash bag with a holder according to the present invention, FIG. 2 (*b*) shows the bag support frame, FIG. 2 (*c*) is a side view showing the relationship between a bracket portion of the bag support frame and a bag support frame fixture which is fixed to a kitchen sink or the like, FIGS. 3 (*a*) and 3 (*b*) are drawings showing how to fasten the trash bag to the bag support frame, FIGS. 4 (*a*) and 4 (*b*) are drawings showing other different combinations of bag support frames and bag support frame fixtures, FIGS. 4 (*c*) and 4 (*d*) show a frame member which is used to fasten the trash bag when the bag is used with a perforated drain basket installed in sink drain and where the frame member is mounted on the perforated drain basket.

In FIG. 1, reference numeral 1 denotes a trash bag with a holder in which to place waste food resulting from the preparation of food, and which comprises a bag support frame 2 and a trash bag 3 having a number of perforations formed therein. The bag support frame 2 is of a compressed elliptical shape. The trash bag 3 in this application is turned inside out relative to the original state thereof when it is properly fastened to the bag support frame 2.

Figure 2A:
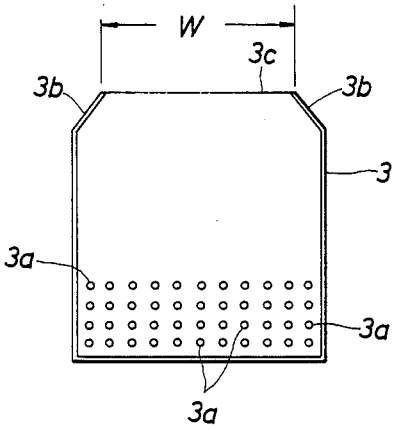
Figure 2B:
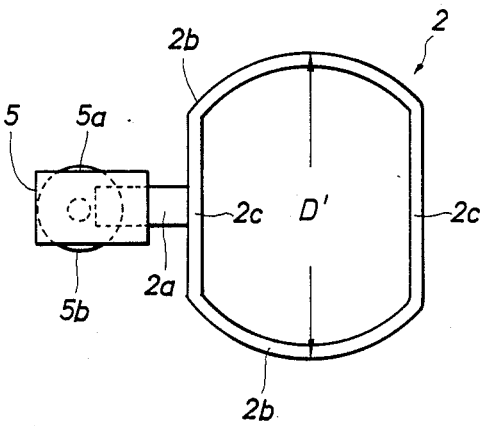
Figure 2C:
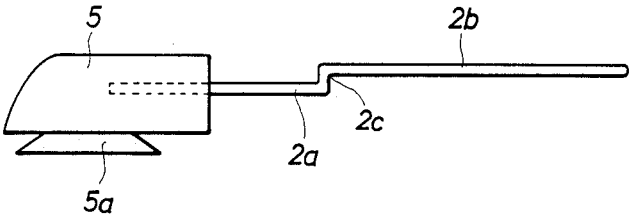

As shown in FIG. 2 (*b*), the bag support frame 2 has at the central portion thereof straight frame portions 2*c*, 2*c*, and a bracket portion 2*a* is integrally formed into one of the straight frame portions 2*c*, 2*c*. The straight frame portions 2*c*, 2*c* are connected to each other at the ends thereof by semi-circular or arc-shaped bag support portions 2*b*, 2*b*, an open fixed shape frame member thus being formed by the bag support portions 2*b*, 2*b* and the straight frame portions 2*c*, 2*c*, so that the bag is held by the whole periphery of the frame member.

The bag support frame 2 is made of a synthetic resin and is integrally molded together with the bracket portion 2*a*. As shown in FIG. 2 (*c*), the bracket portion 2*a* and one of the straight frame portions 2*c*, 2*c* are molded integrally in such a manner that they are stepped, and the end portion of the bracket portion 2*a* is inserted into a fixture hole formed in a bag support frame fixture 5, which is fixed on the counter of a kitchen sink 6, so as to releasably fix the whole bag support frame there. This construction allows the bag support frame 2 to be releasably fixed to the kitchen sink 6, whereby the bag support frame 2 can be detached therefrom when it is not in use. The bag support frame fixture 5 has a sucker device 5*a* and is fixed via the sucker device 5*a* on the counter at a circumferential area 4*a* of a basin compartment 4 so that the trash bag 3 is located in the area of the basin compartment 4.

As shown in FIG. 2 (*a*), the trash bag 3 has a number of perforations 3*a* continuously arranged over the area expanding between the bottom thereof to the vertically intermediate portion to drain water which is put therein together with waste food, an opening 3*c* provided at the top thereof, and two slant joined portions 3*b*, 3*b* provided at both ends of this opening 3*c* in such a manner as to face each other. These joined portions 3*b*, 3*b* slant downwardly to a depth ranging from 10 mm to several tens of millimeters from the opening 3*c* and also slant inwardly through an angle ranging from 20 degrees to around 60 degrees relative to the sides of the bag. When the trash bag 3 is formed of a synthetic resin film, such as vinyl chloride or polyethylene, those joined portions 3*b*, 3*b* may be formed by thermal welding, and, moreover, the thermal welding of the joined portions 3*b*, 3*b* can be performed simultaneously with the thermal welding of the bottom and sides of the bag.

These two thermally joined portions 3*b*, 3*b* provided at both sides of the bag in such a way as to face each other as described above play a critical role in forming a smaller diameter portion in the top opening when the bag is expanded.

The minimum diameter of the smaller diameter portion formed by the joined portions 3*b*, 3*b* is smaller than the diameter of the circumcircle of the bag support portions 2*b*, 2*b* of the bag support frame 2. In this embodiment, the diameter of this smaller diameter portion is, as will be explained below, smaller than the diameter of the circumcircle of the bag support portions 2*b*, 2*b* of the bag support frame 2. What is meant by the diameter of the bag here is the diameter of the opening 3*c* when it is expanded to substantially form a circle.

Figure 3A:
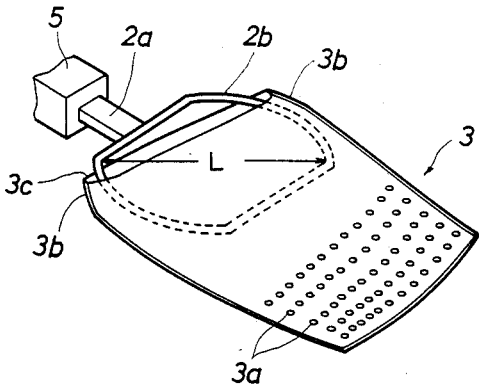
Figure 3B:
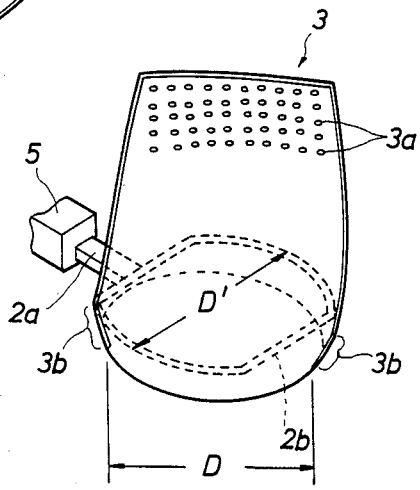
Figure 4A:
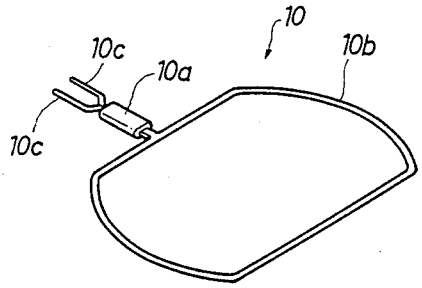
Figure 4B:
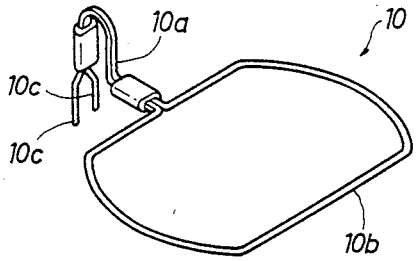
Figure 4B:
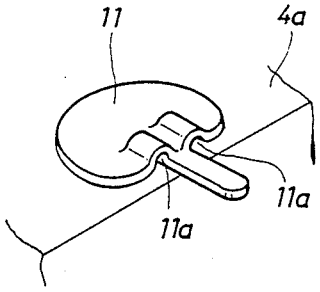
Figure 4B:
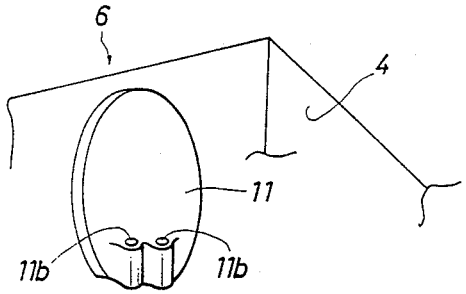
Figure 4C:
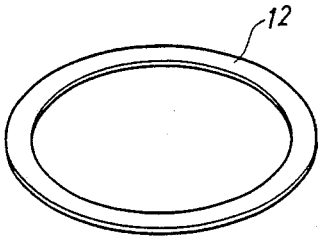
Figure 4D:
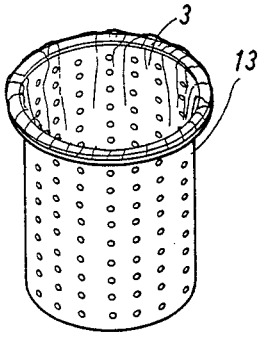
Figure 5A:
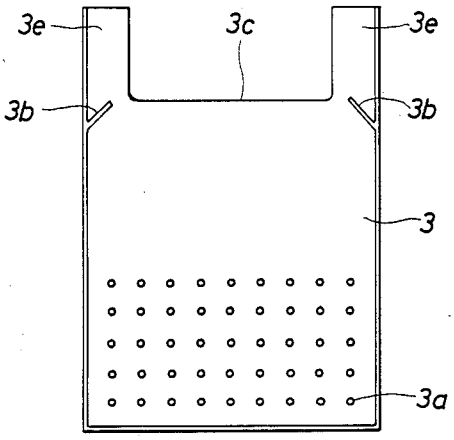
FIGS. 5 (*a*) to (*d*) show another embodiment of the trash bag with a holder according to the present invention.
Figure 5B:
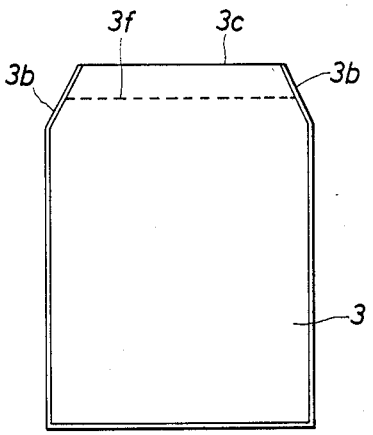
Figure 5C:
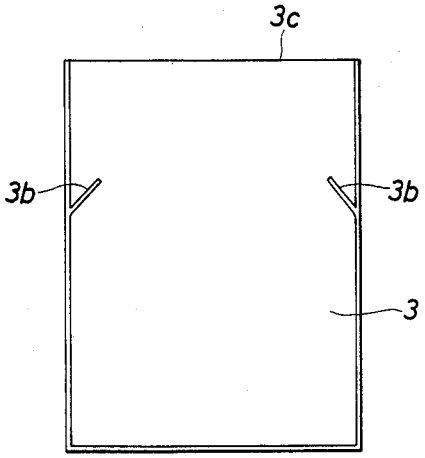
Figure 5D:
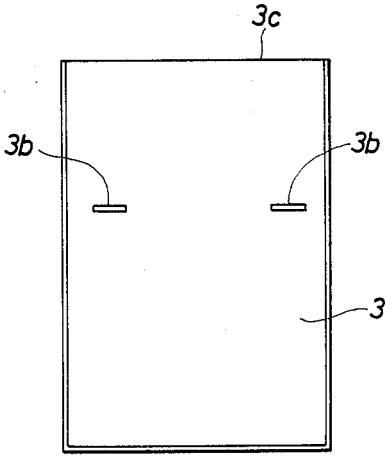

More particularly, the relationship between the bag support frame 2 and the trash bag 3 will be described below. As shown in FIG. 3 (*a*), the width ($W=\pi \cdot D/2$, where D is the minimum diameter of the opening formed when the smaller diameter portion is expanded to be a circle) of the opening 3*c* of the trash bag 3 when it is placed flat become greater than the diameter (D') of the circumcircle of the bag support portions 2*b*, 2*b*. Taking advantage of this relationship, the bag support frame 2 is inserted into the trash bag 3 to engage the smaller portion of the trash bag 3 formed by the joined portions 3*b* with the bag support portions 2*b*, 2*b* thereof. This is a requirement where the trash bag 3 is fastened over the circumcircle of the bag support portions 2*b*, 2*b*.

In this embodiment, however, the bag support frame 2 on which to fasten the trash bag 3 is in the shape of a compressed circle. This enables the bag support frame 2 to be diagonally inserted into the trash bag 3. In this way, with this embodiment, the relationship between the bag opening 3*c* and the bag support frame 2 does not have to be limited to the above-mentioned relationship between the respective diameters D and D', and the width ($W=\pi \cdot D/2$) of the opening 3*c* when the bag is placed flat may be substantially equal to the length L of a diagonal line connecting a junction point between the bag support portion 2*b* of the bag support frame 2 and the straight frame portion 2*c* to the opposite junction point as similarly defined. It is thus possible to insert the bag support frame 2 into the trash bag 3 to support it.

In inserting the bag support frame 2, which acts as a holder, into the trash bag 3 to fasten it thereon, the following procedure is performed: first of all, the bag support frame 2 is diagonally inserted deep into the trash bag 3, the bag 3 is then, as shown in FIG. 3 (*b*), erected upright relative to the bag support frame 2 with the bottom thereof placed upwards, and finally the bottom of the bag is inserted into and passed through the interior space of the bag support frame 2, so that the bag is turned inside out, as shown in FIG. 1. In this way, when the trash bag 3 is inserted into and passed through the interior of the bag support frame 2 to be turned inside out, the smaller diameter portion of the bag 3 formed by the joined portions 3*b* is eventually located over the lower side of the periphery of the bag support portions 2*b*, 2*b* to be supported there.

In unfastening the trash bag 3 which is fastened on the bag support frame 2 by the engagement of the bag support portions 2*b*, 2*b* with the smaller diameter portion, a part of the smaller diameter portion that is in contact with the outer periphery of the bag support frame 2 may be pinched and then pulled in one direction, so that it is forcibly unfastened from the support frame 2. In this way, once a part of the smaller diameter portion is detached from the support frame 2, the whole trash bag 3 will easily be detached from the same.

In the supported condition, the peripheral edge portion of the opening 3*c* of the trash bag 3 simply hangs downwardly from the bag support frame 2 at the front side straight frame portion 2*c* and it hangs from the same onto the bracket portion 2 *a* to lie thereover at the rear straight frame portion 2*c*, whereby the trash bag 3 is prevented from coming off the frame and is securely supported thereon. In addition, the hanging portion of the trash bag 3 serves to facilitate unfastening of the bag from the frame. Furthermore, with this construction, the bracket portion 2*a* needs forming therein no recess for receiving the peripheral edge portion of the trash bag 3. Consequently, the bracket portion 2*a* and the straight frame portion 2*c* do not have to be connected in a manner that the former is located lower than the latter as shown in FIG. 2 (*c*) and may be connected to each other in such a manner that they are level or that the former projects above the latter.

In a case where the trash bag 3 is made of a resin synthetic having relatively high rigidity or a metal, lines of vertical perforations may be provided in the smaller diameter portion in advance to thereby facilitate unfastening of the trash bag from the bag support frame 2 by tearing off those lines or perforations. In addition, where the bag support frame 2 is constructed in such a manner that the frame is free to be connected and disconnected at a certain position thereof to form and break a frame, the diameter of the bag support frame 2 may be tentatively reduced to thereby facilitate unfastening of the trash bag 3. In contrast, the trash bag 3 may be made of a flexible material so that it is easily unfastened from the frame. If the trash bag is flexible, the diameter of the bag support frame 2 may be made slightly greater than with a non-flexible bag by taking advantage of the flexibility thereof. Moreover, if the ba support frame 2 is, as described above, constructed so that it is connected and disconnected at a certain point thereof, or if part of the frame 2 is made of a flexible material, the diameter thereof may be reduced to thereby facilitate fastening of the trash bag 3 on the bag support frame 2. It is thus possible to strengthen further the holding relationship between the trash bag 3 and the bag support frame 2. Even in a case where the bag support frame 2 is adapted to be broken apart at a certain point thereof, the frame 2 should remain integrally connected to the bracket portion 2*a*.

Perforated trash bags 3 may be manufactured by pressing synthetic resin bags made of vinyl chloride or polyethylene to form perforations therein, or by processing a perforated sheet material. Moreover, the perforated trash bag 3 may be a bag provided with meshes or may be made of non-woven material provided with meshes. Thus, there is no limitation on material or shape of the raw material used in manufacturing the trash bag the trash bag 3.

As shown by the perspective view in FIG. 1, the bag support frame 2 is adapted to be releasably fixed relative to the kitchen sink 6. However, the fixture of the frame 2 is not limited to the kitchen sink. The bag support frame 2 may be fixed to table tops, desk tops, dressers and any other places where level surfaces are available. The frame 2 may be fixed in place utilizing double-coated adhesive tapes or by any other means which allows it to be releasably fixed.

FIGS. 4 (*a*) and 4 (*b*) show other combinations of the bag support frames 10 and the fixtures with which to releasably fix the bag support frames 10.

The support frame 10 employed in this embodiment is made of stainless steel or aluminum and comprises a bracket portion 10*a* and a ring portion 10*b*. A pair of attachment pins are provided at the distal end 10*c* of the bracket portion 10*a*, and a pair of insertion grooves 11*a* are provided in the bag support frame fixture 11. In this construction, when the fixture 11 is fixed on a table, desk or the circumferential area of the basin compartment 4 of a kitchen sink 6, the grooves 11*a* form holes in cooperation with the top surfaces of the desk, table or kitchen sink 6, thus making it possible to fix the frame 10 horizontally relative to the table, desk or kitchen sink once the attachment pins 10*c* are inserted in those holes.

FIG. 4 (*b*) shows another example of the bag support frame 10 having a bracket portion 10*a* with attachment pins at its distal end. This example differs from the example shown in FIG. 4 (*a*) in that attachment and/or detachment of the bag support frame 10 can be achieved in a vertical manner. The bag support frame fixture 11 of this example is provided with insertion holes 11*b*, 11*b*, and is capable of being fixed on a vertical surface such as a pillar, the side wall of a desk or dresser, the door of a locker, a wall or the like as well as the side wall of the basin compartment 4 of a kitchen sink 6.

FIGS. 4 (*c*) and 4 (*d*) show an example in which the trash bag is used with a perforated drain basket which is received in a sink drain. Placed on the perforated drain basket 13 as shown in FIG. 4 (*d*), a plastic ring member 12 shown in FIG. 4 (*c*) is used for this purpose. The way of fastening the trash bag is the same as that explained with respect to FIG. 1, but the ring member 12 is not provided with a bracket portion in this example. The trash bag 3 shown in FIG. 2 being fastened thereon, the ring member 12 is placed for use on the circumferential top portion of the perforated drain basket 13.

Various types of trash bags are shown in FIGS. 5 (*a*) to (*d*). A trash bag 3 shown in FIG. 5 (*a*) has sleeve portions 3*e* provided at both sides of the bag in such a manner as to extend upwardly from the top end thereof for use in tying the same bag. In a trash bag shown in FIG. 5 (*b*), slant joined portions 3*b* are made longer as compared with the previously explained example, and a horizontal line of perforations 3*f* is formed in a vertically intermediate portion thereof. The upper end of the bag is separated from the perforations 3*f* and may be used as a string with which to tie the bag. In a trash bag 3 shown in FIG. 5 (*c*), slant joined portions 3*b* are provided at a position slightly higher than the vertically intermediate portion of the bag, and the bag portion above the slant joined portions 3*b* may be used as a margin around which a string or the like is tied to close the bag. In a trash bag 3 shown in FIG. 5 (*d*), the joined portions 3*b* are horizontally provided at positions which are slightly apart from the respective sides of the bag towards the inside thereof.

As is clear from FIGS. 5 (*b*) to (*d*), perforations are not formed in the trash bags shown therein, but if they are used where draining of water is required as in the case of the trash bag used with the perforated drain basket, perforations may be formed therein. However, in most cases other than the use for draining water as described above, perforations are not necessary and, therefore, not provided in the trash bag, which is used as an ordinary trash bag with a holder.

The bags having no perforations formed therein are used as receptacles in which to place trash containing water, and may be used not only, for instance, as receptacles in which to put filth when placed on a dresser or in a toilet but also for various purposes. In these applications, the ring member shown in FIG. 4 (*c*) is placed on the top end of a cylindrical trash can main body and the top lid thereof is, in turn, placed on the ring member 12.

Figure 6:
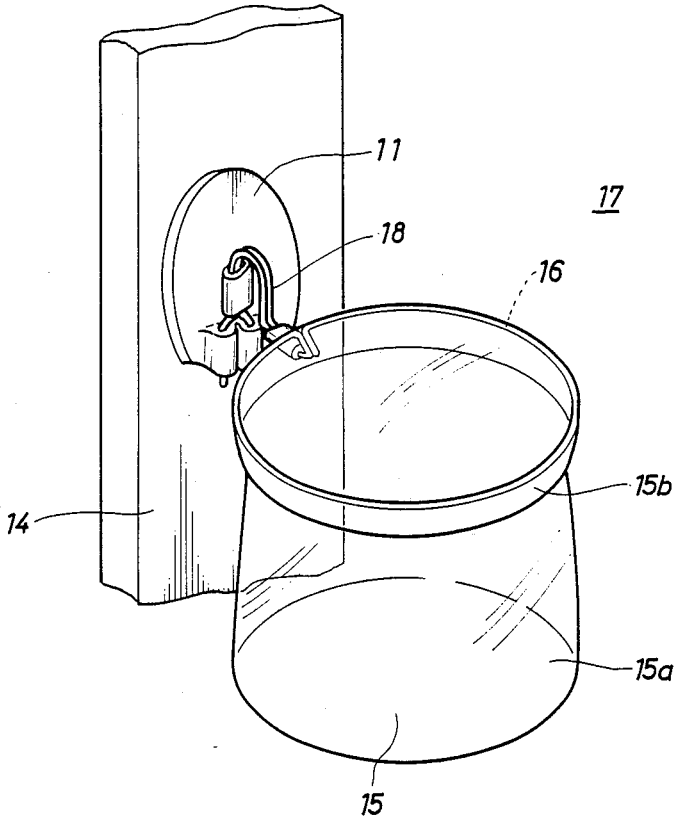
FIG. 6 is a perspective view of the trash bag with a holder according to the present invention which is adapted to be hung on a wall.

FIG. 6 shows a trash bag with a holder 17 in which the bag support frame 2 is fixed on a pillar 14 of a room, and a water-proof transparent synthetic resin bag 15 is fastened thereover. With a trash bag with a holder of this type, water is prevented from leaking from the bag even if trash containing water is placed therein. Moreover, what is contained therein can be seen from outside, and replacement of the trash bag is easily achieved even if the trash bag with a holder is placed at a relatively high position. In FIG. 6, reference numerals 15*a* and 15*b* denote a bag main body and a small diameter portion, respectively.

The trash bag with a holder 17 in this example has a circular bag support frame 16, and the bag is held by the whole periphery of the frame 16. This construction enables the bag to be held there more firmly than with the previously described compressed frame, the trash bag thus being protected more securely against coming off the frame 16 even if a heavy load is applied to the bag. As shown in the figure, in order to avoid any obstruction to a secure holding of the bag 15 on the frame 16, a recess may, when needed, be provided at around a junction between the bracket portion 18 which is fixed to the pillar 14 and the bag support frame 16, in other words, a joined portion between these two members may be bent inwardly downwards for this purpose.

As described above, the trash bags employed in these embodiments are made of a synthetic resin but paper bags may instead be used. Thus, the raw material used in manufacturing the trash bags is not limited to synthetic resin. The joined portions adapted to form the smaller diameter portion are not necessarily thermally welded but may be formed utilizing an adhesive. In this way, this trash bag with a holder may be used for other purposes, for instance, for accommodating therein various kinds of articles, when the bag support frame fixture is fixed on the surface or side of a desk, wall, pillar or the like. Thus, even a flowerpot or the like may be placed in the trash bag.

In the embodiment of the present invention, two joined portions are provided in such a manner as to face each other. This is partly due to the shape of the bag support frame, and the number of the joined portions formed in the bag is not necessarily limited to two but may be four. In contrast, in a case where there is no possibility of a heavy load being applied to the trash bag, and a triangular ring, elastic bag or the like are used as a bag support frame and trash bag, respectively, the trash bag may be well held by the holder frame even if only on joined portions is provided in the bag.

The bag support frame may be made of not only a synthetic resin but also a metal. In addition, the ring portion and bracket portion are not necessarily integrated into one body. The ring portion is also not limited to the shape of a compressed circle but may be in the shape of an ellipse, or even a circle. Thus, there is no limitation on the shape of the bag support frame, as long as it has a ring-like shape.

What is claimed is:

1. A trash bag and support in combination, comprising:

said support having an open fixed shape frame having a bag engaging periphery of a first perimeter from engaging an interior wall portion of the bag;

said bag having a non-elastic bag body having a first circumference greater than said first perimeter and an opening of a fixed second circumference less than said first circumference;

said frame including means for passing said frame through said opening into the bag interior, said means being portions of said frame oppositely disposed along said periphery having a fixed minimum dimension extending therebetween;

said perimeter of said bag engaging periphery being greater than said second circumference of said bag opening for supporting the bag adjacent said opening from the wall portion of the bag when said frame is disposed in the interior of the bag; and said bag being a trash bag having a number of perforations formed therein, and said bag support frame having means for fixing said support frame to a sink.

2. The trash bag and support combination according to claim 1, further including said fixing means being a bracket portion connected to said bag support frame, and said bracket portion being connected to a bag support frame fixture.

3. The trash bag and support combination according to claim 1, wherein said bag support frame is ring shaped and includes a bracket portion connected to a bag support frame fixture as said fixing means, wherein said bracket portion is bent inwardly of said ring portion at the point of connection between said ring portion and said bracket portion.

4. The trash bag and support combination according to claim 1, wherein said bag support frame fixing means includes bracket means for releasably fixing said bag support frame to a kitchen sink.

5. A trash bag and support in combination, comprising:

said support having a fixed shape frame having a peripheral bag engaging portion having a perimeter;

said bag having a non-elastic bag body of a first circumference greater than said perimeter;

said bag having an opening of a fixed second circumference and means for engaging said peripheral bag engaging portion of said frame along an interior wall of the bag adjacent said opening with said bag in an upright orientation relative to said frame and further for supporting said bag on said wall portion of said bag in a hanging orientation opposite to said upright orientation.

6. The trash bag and support combination according to claim 5, wherein said engaging and supporting means comprises at least two joined portions of the bag that face each other to provide said opening with said second circumference that is smaller than the perimeter of the frame.

7. The trash bag and support combination according to claim 5, further including a bracket portion connected to said frame, and said frame having an elliptical shape including facing semi-circular portions thereof.

8. The trash bag and support combination according to claim 5, wherein said bag has a pair of sleeve portions projecting upwardly from said wall of the bag for tying the bag shut to enclose the contents thereof.

9. A trash bag and support in combination, comprising:

said trash bag having a non-elastic bag body having a first circumference including a bottom wall and sides extending upwardly therefrom, an opening of a fixed second circumference at a top portion of the bag, and at least two joined portions across the top of the bag adjacent the opening for reducing the second circumference of the bag at the opening when the bag is expanded;

said support having a fixed shape frame having a bag engaging periphery defining a perimeter that is greater than the second circumference of the bag opening and less than the first circumference of the bag body, and said frame further including means for permitting said frame to be fully inserted into an interior of the bag body through said opening; and said bag further having means for engaging said periphery of said frame when said frame is disposed interiorly of the bag in an upright orientation of the bag with respect to the frame and further for supporting the bag in a hanging orientation opposite to the upright orientation when said bottom of the bag is passed through said opening, said means for engaging and supporting being a wall portion of said joined portions, whereby said bag is turned inside-out in changing the bag from the upright orientation to the hanging orientation.

10. The trash bag and support combination according to claim 9, wherein said bag is formed from at least one sheet of synthetic resin material that is thermally welded along at least one of its side and bottom edges respectively and wherein said two joined portions face each other and are formed by thermally welding opposite sides of the bag along a weld line extending inwardly from the side edges of the bag toward the opening.

11. The trash bag and support combination according to claim 9, wherein said bag has a number of perforations provided in the bottom wall of the bag.

12. The trash bag and support combination according to claim 9, wherein said bag has meshes formed in the bottom wall of the bag.

13. The trash bag and support in combination according to claim 9, wherein said bag has a number of perforations provided in said bag sides adjacent said bottom wall.

14. The trash bag and support combination according to claim 9, wherein said bag has meshes formed in said bag sides adjacent said bottom wall of the bag.

15. The trash bag and support combination according to claim 1, wherein said fixed shape of said frame is substantially elliptical.

16. The trash bag and support combination according to claim 1, wherein said frame is of a substantially circular fixed shape and said minimum dimension is a diameter of the circular fixed shape frame.

17. The trash bag and support combination according to claim 1, wherein said fixed shape of said frame includes two facing semi-circular sections joined together by a pair of straight frame sections at junction points, and said fixed minimum dimension is along a diagonal extending between said junction points.

18. The trash bag and support combination according to claim 1, wherein said fixed minimum dimension is substantially equal to one half of said second circumference of said bag opening.

19. The trash bag and support combination according to claim 5, further comprising said bag opening having a second circumference and said perimeter being greater than said second circumference; and said means for passing said frame through said bag opening into an interior of the bag being portions of said frame oppositely disposed along said periphery having a fixed minimum dimension extending therebetween.

* * * * *